US007502487B2

(12) United States Patent
Watanabe

(10) Patent No.: US 7,502,487 B2
(45) Date of Patent: Mar. 10, 2009

(54) SPEAKER DEVICE

(75) Inventor: Tomoyuki Watanabe, Yamagata (JP)

(73) Assignees: Pioneer Corporation, Tokyo (JP); Tohoku Pioneer Corporation, Tendo-Shi (JP)

( * ) Notice: Subject to any disclaimer, the term of this patent is extended or adjusted under 35 U.S.C. 154(b) by 793 days.

(21) Appl. No.: 11/083,996

(22) Filed: Mar. 21, 2005

(65) Prior Publication Data

US 2005/0276435 A1 Dec. 15, 2005

(30) Foreign Application Priority Data

Mar. 19, 2004 (JP) ..... 2004-080162

(51) Int. Cl.
*H04R 25/00* (2006.01)

(52) U.S. Cl. ..... 381/409; 381/410; 381/403; 381/404; 381/400; 381/407; 381/411

(58) Field of Classification Search ..... 381/400, 381/403, 404, 407, 409–411, 416
See application file for complete search history.

(56) References Cited

U.S. PATENT DOCUMENTS 6,088,466 A * 7/2000 Proni ..... 381/397
6,700,988 B2 * 3/2004 Wu ..... 381/404
7,035,424 B1 * 4/2006 Brandt ..... 381/409
7,263,198 B2 * 8/2007 Onuma ..... 381/403

FOREIGN PATENT DOCUMENTS

| | | |
|---|---|---|
| JP | 9-9381 | 1/1997 |
| JP | 2000-312397 | 11/2000 |
| JP | 2001-54190 | 2/2001 |

* cited by examiner

*Primary Examiner*—Suhan Ni
*Assistant Examiner*—Jasmine Pritchard
(74) *Attorney, Agent, or Firm*—Young & Thompson

(57) ABSTRACT

A speaker device includes a terminal member, a connecting member, a conductive damper and a voice coil. The terminal member has a first connecting part, a slit, a hole, a second connecting part and a fixing part. The connecting member has a projecting portion on a bent portion and a groove at an area in the vicinity of a lower end of an outer peripheral wall of the cylindrical portion. The terminal member is mounted to the connecting member. A lead wire is wound around the slit of the connecting part, and a portion thereof is soldered. The projecting portion is inserted into the hole. The fixing part is inserted into the groove. The second connecting part is connected to a conductive member of the conductive damper disposed at the area in the vicinity of the lower end of the outer peripheral wall of the cylindrical portion by the soldering.

4 Claims, 12 Drawing Sheets

600

601

SPEAKER DEVICE

TECHNICAL FIELD

The present invention relates to a wiring structure of a speaker device.

BACKGROUND ART

Conventionally, there is known an internal magnet type speaker device including a magnetic circuit including a planar magnet, a planar plate and a pot-shaped yoke, and a vibration system including a conductive damper made by weaving a conductive member, a connecting member made of a resin material, a voice coil, a voice coil bobbin and a frame.

In such a speaker device, the connecting member movably supports the voice coil bobbin. The connecting member has a cylindrical portion in a substantially cylindrical shape at a position opposite to the outer peripheral wall of the voice coil bobbin. An inner peripheral edge portion of the conductive damper is mounted to an outer peripheral wall of the cylindrical portion via an adhesive. A lead wire drawn from the voice coil is drawn along the outer peripheral wall of the voice coil bobbin, an upper end surface of the connecting member and an outer peripheral wall of the cylindrical wall, to be connected to one end side of the conductive member of the conductive damper by soldering.

However, in the above-mentioned speaker device, since the lead wire of the voice coil is fine, when the lead wire is drawn, the lead wire is problematically cut.

In order to prevent the lead wire from being cut, it is necessary to perform the work of drawing the lead wire up to the side of the conductive damper and soldering the fine lead wire and one end side of the conductive member of the conductive damper. The work of the soldering is problematically extremely inefficient.

In addition, in the above-mentioned speaker device, for the purpose of preventing ignition at the time of inputting a direct current to the lead wire and preventing occurrence of a collision sound of the lead wire and the connecting member at the time of driving the speaker, after soldering the lead wire to the conductive member of the conductive damper, a portion of the lead wire contacting the connecting member is solidified by an adhesive having fire resistant property to be reinforced. However, in this case, if the adhesive is applied to the portion at which the outer peripheral wall of the cylindrical portion of the connecting member and the lead wire contact each other, since the outer peripheral wall of the cylindrical portion is substantially parallel with the center axial direction of the speaker device, the adhesive drips down to the lower side of the cylindrical portion, and particularly an upper portion of the lead wire is problematically exposed.

As the wiring structure of the speaker by using the conductive damper, there is known a wiring structure of a speaker formed by connecting a conductive material of a conductive damper and a folded portion formed in an end portion of a coil wire wound around the voice coil bobbin, for example (see Japanese Patent Application Laid-Open under No. 2000-312397).

There is also known a wiring structure of a speaker in which a housing with a lead wire is mounted at a mounting portion provided at a terminal ring mounted to an overlap width portion of a conductive damper, and a connecter lug and a tinsel cord in a plain stitch of the conductive damper are connected and wired (see Japanese Patent Application Laid-Open under No. 9-9381, for example).

Moreover, there is known a wiring structure of a speaker device in which a recessed portion is formed at one portion of a damper inner peripheral portion of a conductive damper, an end portion of a conductive material is mounted along a bottom surface of the recess, and the end portion of the conductive material is connected to the voice coil (see Japanese Patent Application Laid-Open under No. 2001-54190, for example).

DISCLOSURE OF THE INVENTION

As an object to be achieved by the present invention, the above described object is cited as an example. The present invention has its object to provide a speaker device having a wiring structure capable of preventing a lead wire from being cut at the time of connecting a conductive damper or a tinsel cord with the lead wire of a voice coil, and improving efficiency of work.

According to one aspect of the present invention, there is provided a speaker device including: a frame; a conductive damper which has an outer peripheral edge portion supported by the frame; a connecting member which is mounted to the conductive damper and which movably supports a voice coil bobbin; a voice coil which is wound around the voice coil bobbin; and a terminal member which is mounted to the connecting member and which is electrically connected to the conductive damper and the voice coil.

In the above speaker device, by mounting the terminal member to the connecting member, the terminal member can be electrically connected to the lead wire of the voice coil and the conductive member of the conductive damper respectively. Concretely, the lead wire drawn from the voice coil is drawn up to the area in the vicinity of the upper surface of the connecting member along the outer peripheral wall of the voice coil bobbin, and is connected to the side of the one end of the terminal member. Therefore, the length of drawing the fine lead wire can be shortened. That is, it is unnecessary that the fine lead wire of the voice coil is drawn up to the conductive member of the conductive damper along the upper surface of the connecting member and the outer peripheral wall of the connecting member. Therefore, it is unnecessary that the lead wire is drawn in the long distance like this, and it can be prevented that the lead wire is cut due to the drawing.

By mounting the terminal member to the connecting member, the terminal member and the conductive member of the conductive damper contact each other, and they are easily electrically connected. Thereby, the work of soldering the contact portion of the terminal member and the conductive member can be rapidly and easily performed.

In a form of the above speaker device, a projecting portion projecting upward may be formed on an upper end surface of the connecting member, and a groove may be formed at a lower end portion of the connecting member, and a hole into which the projecting portion is inserted may be formed on an upper end surface of the terminal member, and a fixing part which is inserted into the groove may be formed at a lower end portion of the terminal member.

In accordance with the form, the projecting portion of the connecting member can be inserted into the hole of the terminal member, and the fixing part of the terminal member can be inserted into the groove of the connecting member. Thereby, the terminal member can be easily mounted to the connecting member.

In another form of the above speaker device, the terminal member may have a slit or a hole to which a lead wire of the voice coil is connected. Thereby, the lead wire of the voice coil can be wound around the slit or the hole of the terminal member. Thus, the work of electrically connecting the voice coil and the terminal member by soldering, for example, can be easily performed.

In another form of the above speaker device, a connecting part for electrically connecting to a conductive member of the conductive damper may be formed at the lower end portion of the terminal member.

In accordance with the form, by mounting the terminal member to the connecting member, the connecting part of the terminal member and the conductive member of the conductive damper contact each other. Therefore, by soldering at the portion, the terminal member and the conductive damper can be easily electrically connected to each other.

According to another aspect of the present invention, there is provided a speaker device including: a frame; a damper which has an outer peripheral edge portion supported by the frame; a connecting member which is mounted to the damper and which movably supports a voice coil bobbin; a tinsel cord which is electrically connected to a amplifier; a voice coil which is wound around the voice coil bobbin; and a terminal member which is mounted to the connecting member and which is electrically connected to an end portion of the tinsel cord and the voice coil. In a preferred example, a corn-shape diaphragm is applicable to the speaker device.

In the above speaker device, by mounting the terminal member to the connecting member, the terminal member can be, rapidly and easily, electrically connected to the lead wire of the voice coil and the tinsel cord.

In a form of the above speaker device, a projecting portion projecting upward may be formed on an upper end surface of the connecting member, and a groove may be formed at a lower end portion of the connecting member, and a hole into which the projecting part is inserted may be formed on an upper end surface of the terminal member, and a fixing part which is inserted into the groove may be formed at a lower end portion of the terminal member.

In accordance with the form, the projecting part of the connecting member is inserted into the hole of the terminal member, and the fixing part of the terminal member is inserted into the groove of the connecting member. Thereby, the terminal member can be easily mounted to the connecting member.

In a form of the above speaker device, the terminal member may have a slit or a hole for connecting the tinsel cord.

In accordance with the form, the one end side of the tinsel cord can be wound around the slit or the hole of the terminal member. Thus, the work of electrically connecting the tinsel cord and the terminal member by soldering, for example, can be easily performed.

BEST MODE FOR CARRYING OUT THE INVENTION

A preferred embodiment of the present invention will be explained hereinafter with reference to the drawings. In this embodiment, the terminal member for connecting the lead wire of the voice coil and the conductive member of the conductive damper is provided. The terminal member is mounted to the connecting member, and the lead wire of the voice coil and the conductive member of the conductive damper are connected to each other via the terminal member. Thereby, it is attempted to prevent the cutting of the lead wire and improve the efficiency of the work at the time of connecting them.

Figure 1:
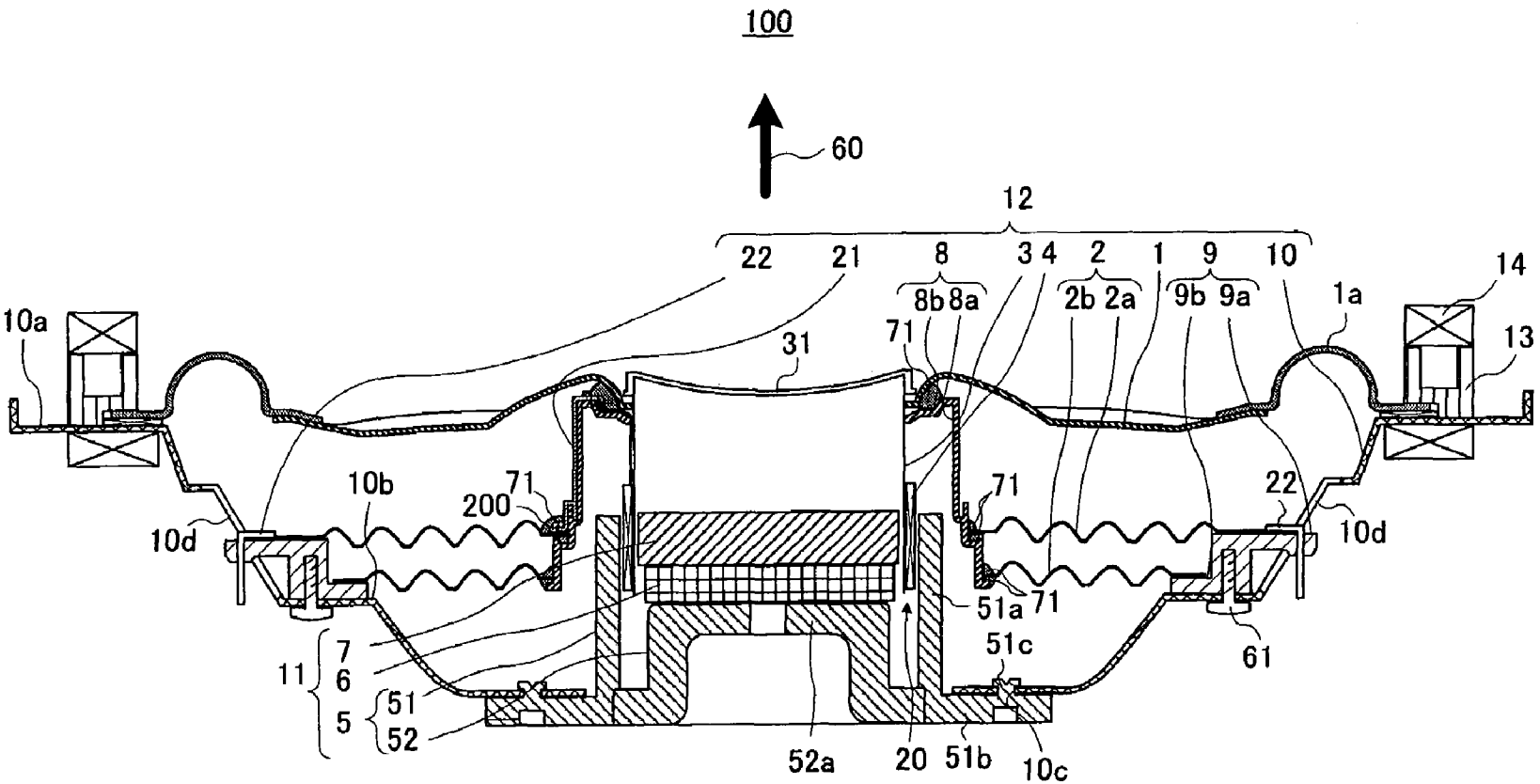
FIG. 1 shows a sectional view of a speaker device according to an embodiment of the present invention.

FIG. 1 schematically shows a construction of a speaker device 100 according to the embodiment of the present invention. The speaker device 100 of this embodiment can be preferably used as the on-vehicle speaker. FIG. 1 shows a sectional view when cutting the speaker device 100 by a plane including a center axis thereof. Referring to FIG. 1, the construction and the like of the speaker device 100 of this embodiment will be explained hereinafter.

As shown in FIG. 1, the speaker device 100 mainly includes a vibration system 12 having a frame 10, a support member 9, a voice coil bobbin 3, a connecting member 8, a damper 2, terminal members 21, terminal members 22, a voice coil 4 and a diaphragm 1, a magnetic circuit system 11 having a pot type yoke 5, a magnet 6 and a plate 7, and an antidust cap 31 and various kinds of other members.

First, each of the components of the vibration system 12 will be explained.

Various components of the speaker device 100 are fixed to the frame 10, and the frame 10 has the function of supporting these components. The frame 10 is made of a metal material with favorable thermal conductivity. Therefore, the frame 10 has the function of a medium which transmits heat between an external space of the speaker device 100 and an internal space thereof. The frame 10 is formed into a pan-shape or a pot-shape which is opened upward, and has a first flange part 10*a* which is formed at an upper part and supports an outer peripheral edge portion or the like of the diaphragm 1, a second flange part 10*b* which is formed at an intermediate part and supports the support member 9, openings 10*c* formed in an inner peripheral edge portion, and a plurality of openings 10*d* formed at a side wall between the first flange part 10*a* and the flange part 10*b*. A plurality of openings 10*c* are formed in a circumferential direction of the inner peripheral edge portion with constant spaces between them. Each of projecting parts 51*c* of the pot-type yoke 5 before deformation, which will be described later, is inserted in each of the openings 10*c*.

The support member 9 is made of, for example, a resin material, and is formed into a substantially annular shape in the plane view. The support member 9 is formed into a step shape in the sectional view, and has an upper surface 9*a* and an upper surface 9*b*. The support member 9 is mounted to the second flange part 10*b* by a fixing member 61 such as a male screw and a bolt, for example.

The voice coil bobbin 3 is formed into a substantially cylindrical shape. The voice coil 4 is wound around an outer peripheral wall of a lower end portion of the voice coil bobbin 3. An inner peripheral wall of the lower end portion of the voice coil bobbin 3 is opposed to outer peripheral walls of the planar magnet 6 and plate 7 with a fixed space from them. Further, the outer peripheral wall of the lower end portion of the voice coil bobbin 3 is opposed to an outer peripheral wall of an upper end portion of a pole piece 5 with a fixed space apart from it. A clearance (a magnetic gap 20) is formed between the inner peripheral wall of the upper end portion of the pole piece 5 and the outer peripheral wall of the plate 7.

The connecting member 8 is made of a resin material, for example, and has a cylinder portion 8*a* formed into a substantially cylindrical shape and a bent portion 8*b* formed in a fashion being bent inwardly from an upper end of the cylinder portion 8*a*, and is made by integrally forming them. An inner peripheral edge portion of the connecting member 8, namely, the inner peripheral edge portion of the bent portion 8*b* is fixed to the vicinity of an upper end of the outer peripheral wall of the voice coil bobbin 3.

The damper 2 has a conductive damper 2*a* and an ordinary damper 2*b*. The conductive damper 2*a* is disposed above the damper 2*b*. The conductive damper 2*a* has the plural conductive members not shown. Each conductive member is sewn onto the upper surface of the conductive damper 2*a* from the inner peripheral edge portion of the conductive damper 2*a* to the outer peripheral edge portion thereof. The outer peripheral edge portion of the damper 2*b* is fixed onto the upper surface 9*b* of the support member 9, and the inner peripheral edge portion of the damper 2*b* is fixed to the lower end portion of the connecting member 8 via the adhesive 71. Meanwhile, the outer peripheral edge portion of the conductive damper 2*a* is fixed onto the upper surface 9*a* of the support member 9, and the inner peripheral edge portion of the conductive damper 2*a* is fixed to the area in the vicinity of the lower end of the connecting member 8 via the adhesive 71.

The terminal member 21 is a member of metal or the like having conductivity, and a plurality of the terminal members 21 are provided. Each of the terminal members 21 is mounted to the connecting member 8. The upper end of each terminal member 21 is electrically connected to each lead wire of the voice coil 4, and the lower end of each terminal member 21 is electrically connected to each conductive member of the conductive damper 2*a*. It is noted that the detailed wiring structure will be explained later.

The terminal member 22 is a member having conductivity, and a plurality of terminal members 22 are provided. Each of the terminal members 22 is fixed to the top surface 9*a* of the support member 9. One end of each of the terminal members 22 is electrically connected to each of the conductive members of the conductive damper 2*a*, and the other end of each of the terminal members 22 is electrically connected to a relay wiring at the side of an amplifier not shown.

The voice coil 4 has a pair of plus/minus lead wires (not shown). The lead wire at the positive side is an input wiring for an L (or R)-channel signal, and the leadwire at the negative side is an input wiring for a ground (GND: ground) signal. Each of the lead wires is electrically connected to an upper end of each of the terminal members 21 as described above. Therefore, an electric signal of one channel is inputted into the voice coil 4 from the amplifier side via each of the terminal members 22, each of the conductive members of the conductive damper 2*a*, each of the terminal members 21 and each of the lead wires.

The diaphragm 1 is formed into a substantially planar shape to be made thin. Various kinds of materials such as paper, high polymer and metal can be applied to the diaphragm 1 in accordance with the various use purposes. An edge part 1*a* which is separate from the diaphragm 1 is mounted to an outer peripheral edge portion of the diaphragm 1. The outer peripheral edge portion of the diaphragm 1 is fixed to the first flange part 10*a*. Meanwhile, an inner peripheral edge portion of the diaphragm 1 is fixed to the vicinity of the upper end of the outer peripheral wall of the voice coil bobbin 3. The inner peripheral edge portion of the diaphragm 1 and the bent portion 8*b* of the connecting member 8 are fixed to each other via the adhesive 71.

Next, each component of the magnetic circuit system 11 will be explained.

The magnetic circuit system 11 is constructed as an internal magnet type magnetic circuit. This magnetic circuit has the pot type yoke 5, the planar magnet 6 and the planar plate 7.

The pot type yoke 5 has a body part 51 and a bottom part 52, and is formed by connecting them. The pot type yoke 5 is mounted to the frame 10.

The body part 51 has a cylinder part 51*a*, a flange part 51*b* and projecting parts 51*c* projecting upward from a top surface of the flange part 51*b*, and is made by integrally forming them. The cylindrical part 51*a* is formed into a substantially cylindrical shape. The cylinder part 51*a* extends upward from the vicinity of the inner periphery of the flange part 51*b* to the position in the vicinity of the plate 7. The flange part 51*b* extends in an outward direction substantially perpendicularly from the vicinity of the lower end of the outer peripheral wall of the cylindrical part 51*a*. The inner peripheral edge portion of the frame 10 is mounted to a top surface of the flange part 51*b*. The projecting part 51*c* is formed into a columnar shape, and a plurality of the projecting parts 51*c* are formed on the top surface of the flange part 51*b* with a constant space apart from each other. Each of the projecting parts 51*c* plays a role of fixing the inner peripheral edge portion of the frame 10 by being caulked.

The bottom part 52 has the sectional shape which is a substantially inversed recessed shape, and has amounting part 52*a* which has substantially the same size as the diameters of the planar magnet 6 and the planar plate 7. The outer peripheral edge portion of the bottom part 52 is connected to the body part 51.

The planar magnet 6 is fixed onto the mounting part 52*a* of the bottom part 52 of the pot type yoke 5. The planar plate 7 is fixed onto the magnet 6. In the magnetic circuit system 11, the magnetic circuit is constructed by the magnet 6 and the plate 7, and a magnetic flux of the magnet 6 is concentrated to the magnetic gap 20 formed between the outer peripheral wall of the plate 7 and the inner peripheral wall of the pot type yoke 5.

The antidust cap 31 is mounted to an upper end portion of the voice coil bobbin 3 via an adhesive to close a top surface of the voice coil bobbin 3. Thereby, the antidust cap 31 has the function of preventing a foreign matter or the like from entering the inside of the speaker device 100.

Next, various kinds of components will be explained.

Various kinds of components include the members such as packing 13 and a buffering member 14.

The packing 13 is formed into an annular shape, and is a member having insulation properties. As a material of the packing 13, for example, a resin material is preferable. An undersurface of the packing 13 is fixed to the first flange part 10*a* and an outer peripheral edge portion of the edge part 1*a*, respectively. As a result, the outer peripheral edge portions of the diaphragm 1 and the edge part 1*a* are held between the packing 13 and the first flange part 10*a*.

The buffering member 14 has the function as the buffering member when the speaker device 100 is mounted to a predetermined position of a vehicle, for example, and has the function of preventing a vibration from an outside from being transmitted to the body of the speaker device 100. Therefore, a member of sponge or the like having cushioning properties is preferable as the material of the buffering member 14. The buffering member 14 is formed into a rod shape in the state before being mounted, with one side surface coated with an adhesive, or a double-side adhesive tape attached on the one side surface. The buffering member 14 is mounted on the top surface of the packing 13 via the adhesive or the double-side adhesive tape in the state in which it is deformed into an annular shape.

In the speaker device 100 described above, the electric signal outputted from the amplifier side is supplied to the voice coil 4 via each of the terminal parts 22, each of the conductive members of the conductive damper 2*a*, each of the terminal members 21, and each of the lead wires of the voice coil 4. Thereby, a driving force occurs to the voice coil 4 in the magnetic gap 20, which vibrates the diaphragm 1 in the axial direction of the speaker device 100. The speaker device 100 thus emits sound waves in the direction of the arrow 60.

[Wiring Structure of Speaker Device]

Figure 2C:
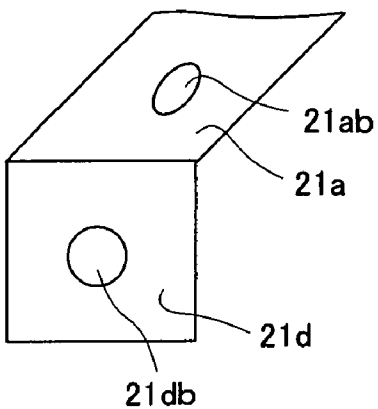
FIGS. 2A to 2C are perspective views of a terminal member according to this embodiment.
Figure 2B:
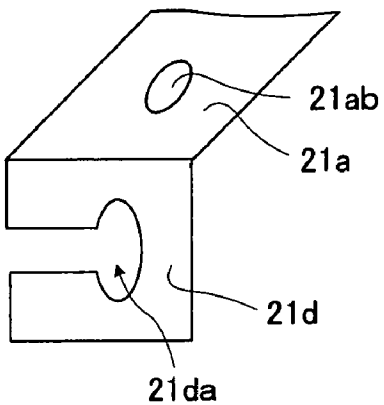
Figure 2A:
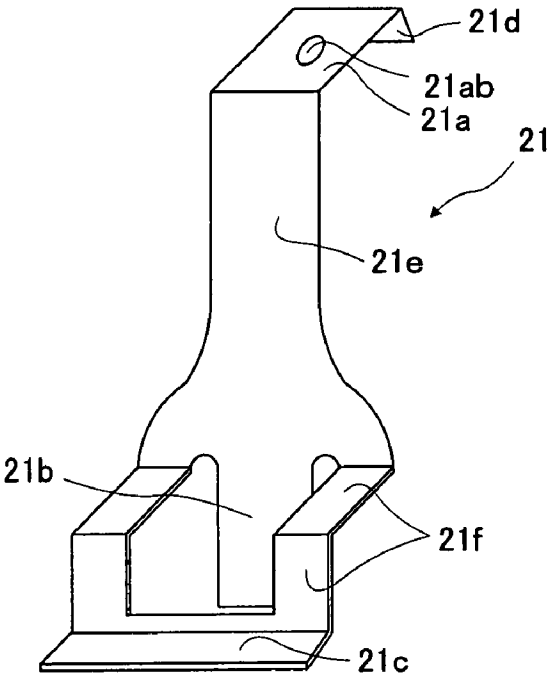
Figure 3A:
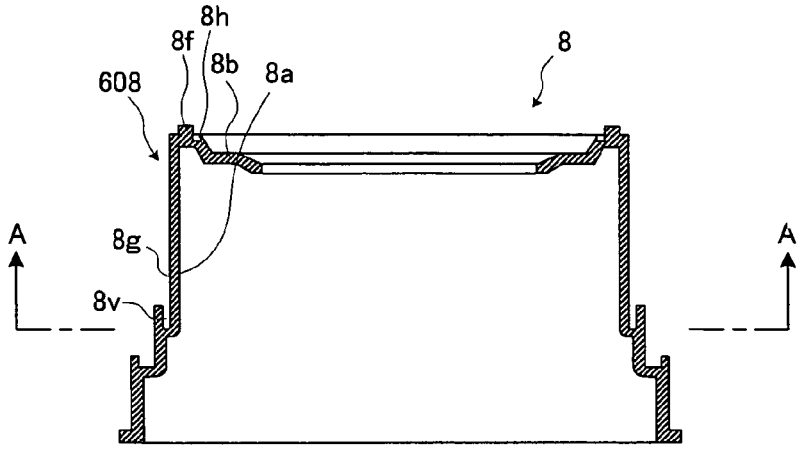
FIG. 3A is a sectional view of a connecting member according to this embodiment.
Figure 3B:
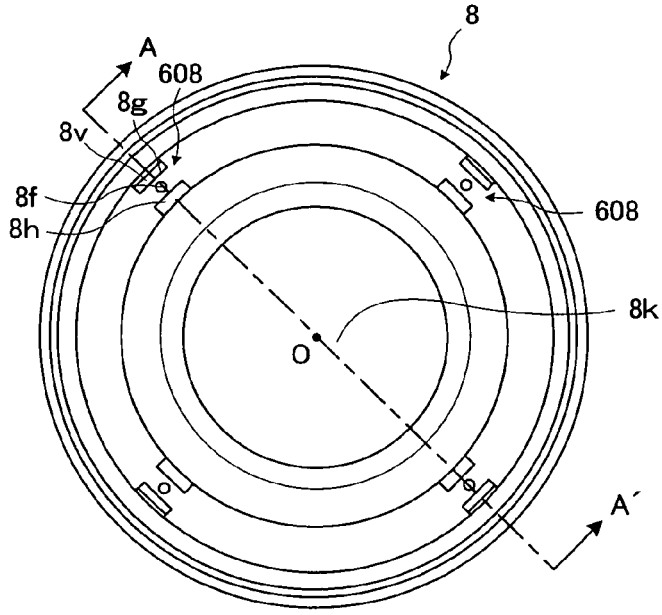
FIG. 3B is a plan view thereof.
Figure 4:
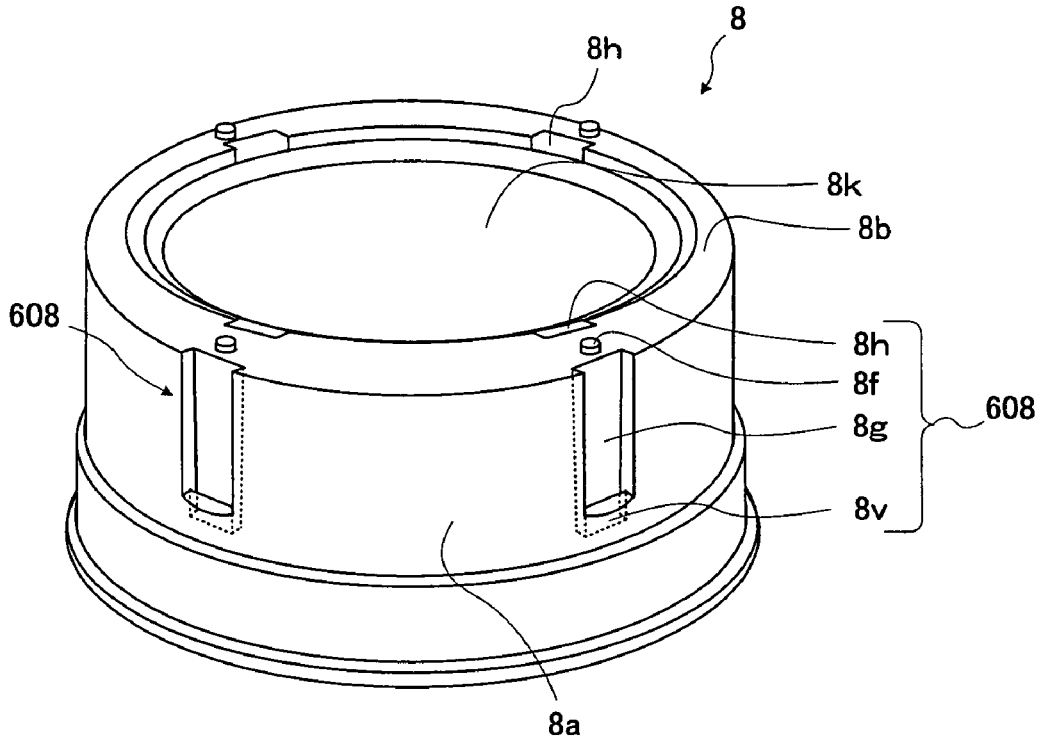
FIG. 4 is a perspective view of the connecting member according to this embodiment.
Figure 5:
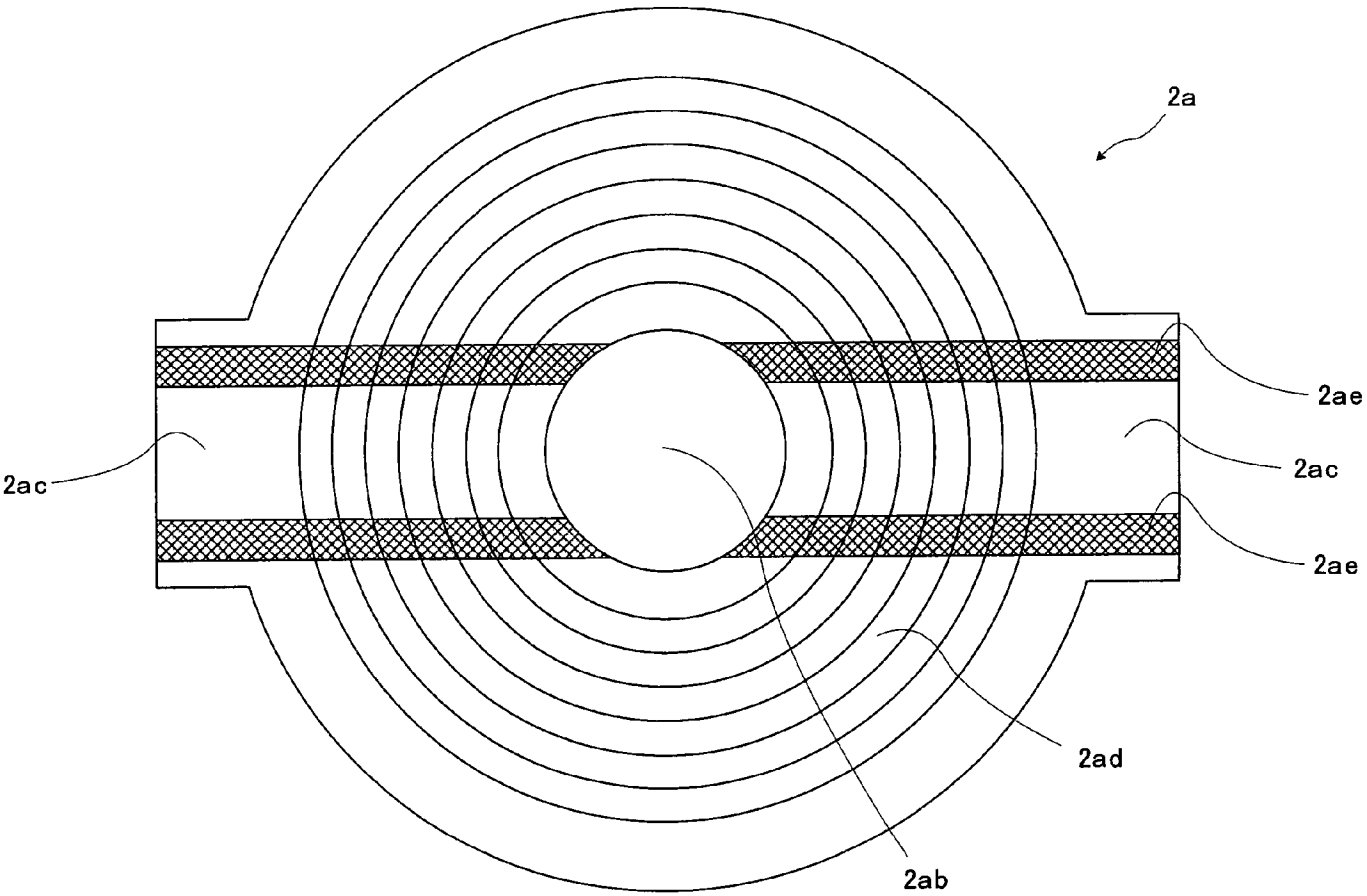
FIG. 5 shows a plan view of a conductive damper according to this embodiment.
Figure 6:
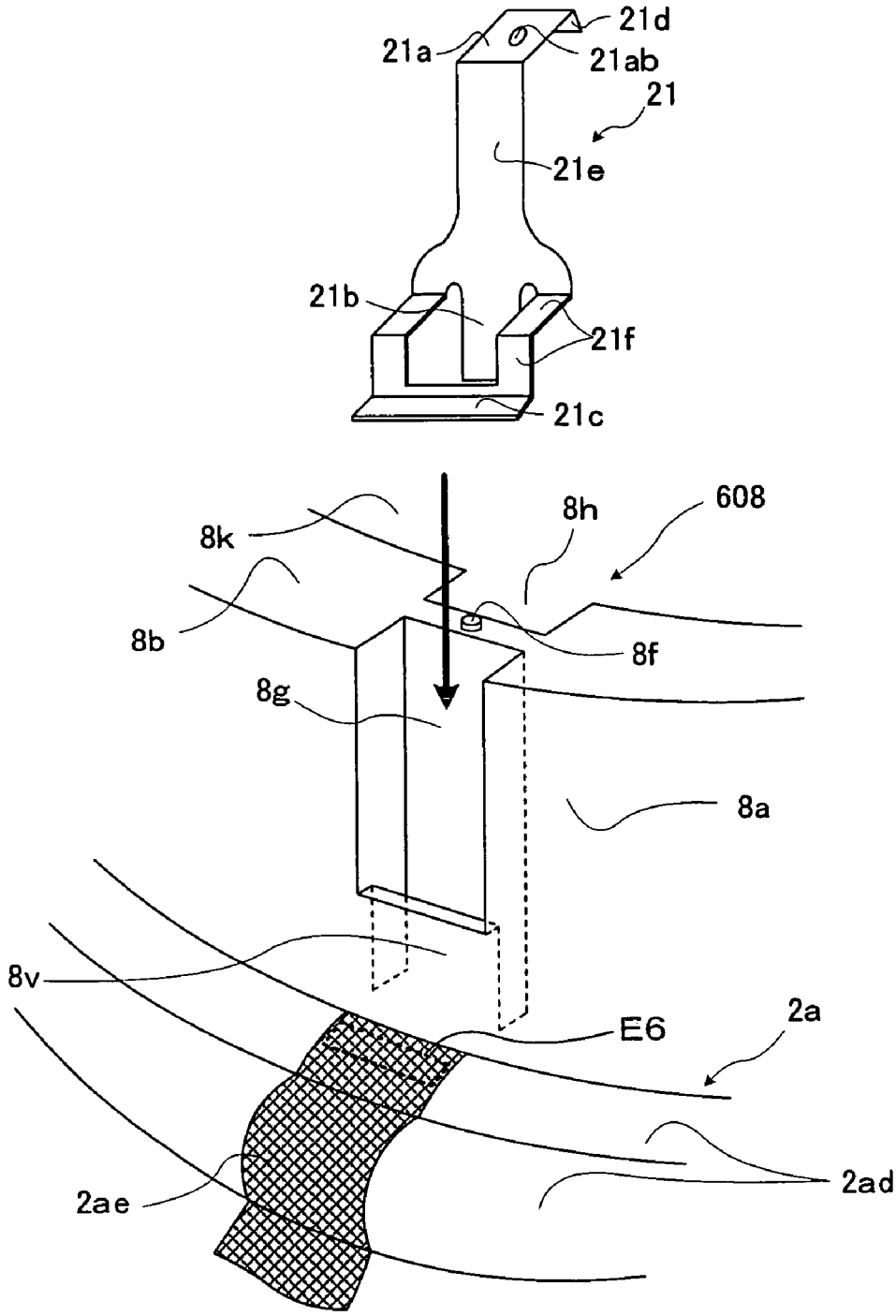
FIG. 6 is a perspective view of a local part of the connecting member and the like showing a method of mounting the terminal member to the connecting member.
Figure 7:
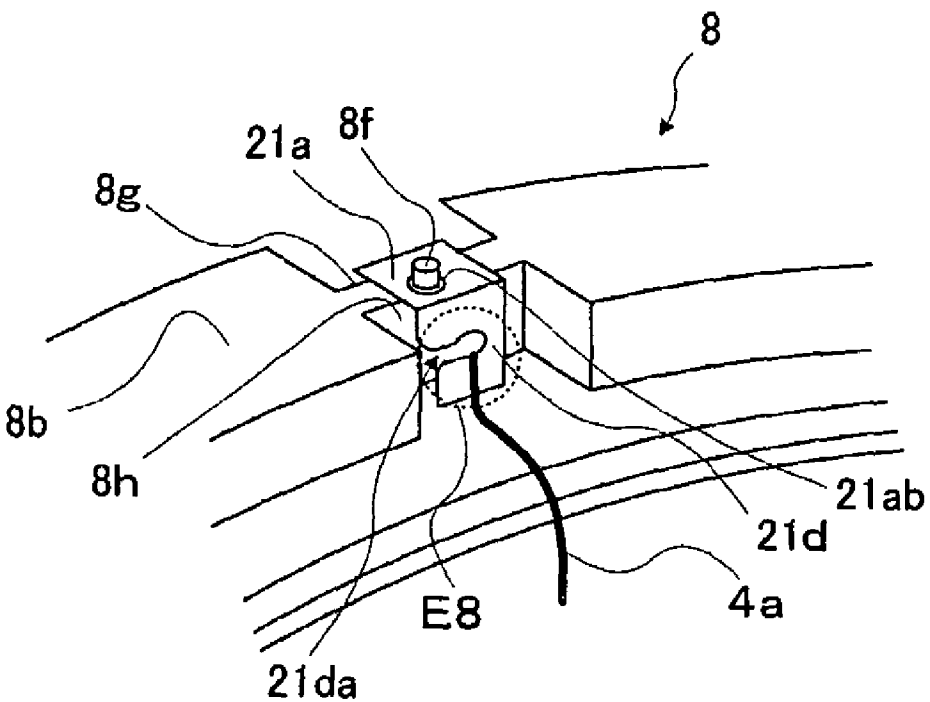
FIG. 7 is a perspective view of a local part of the connecting member and the like showing a method of connecting a lead wire and a terminal member.
Figure 8:
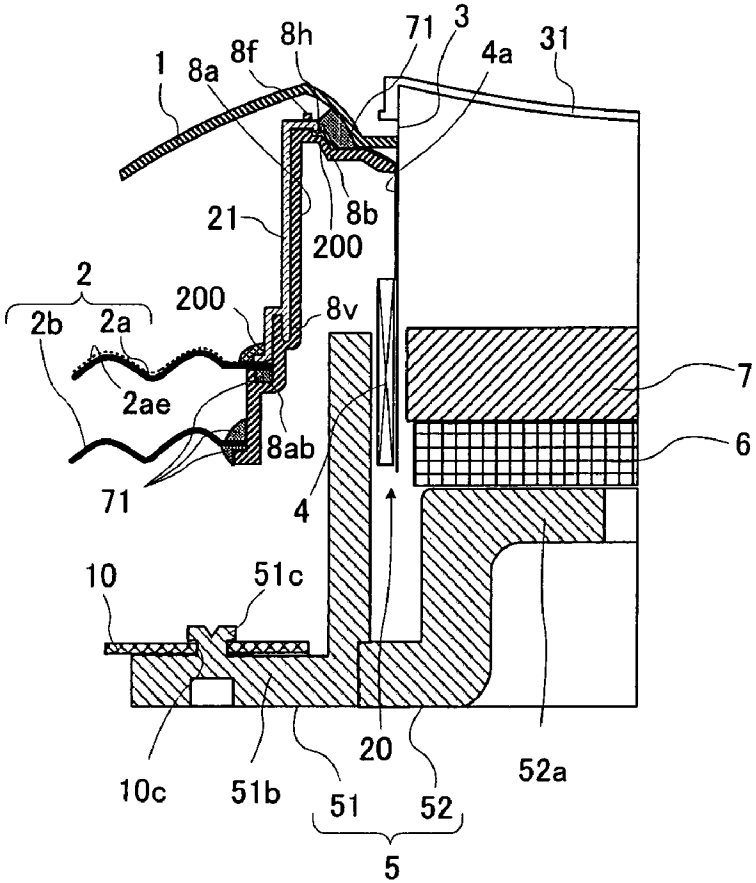
FIG. 8 is a sectional view of a local part of the speaker device showing a condition of connecting the terminal member and the connecting member.

Next, the description will be given of the detailed wiring structure of the speaker device 100, which is a characteristic of the present invention, with reference to FIGS. 2A to 2C to FIG. 8. FIG. 2A shows a perspective view of the terminal member 21 according to this embodiment. FIG. 2B shows a perspective view in which a local part of the vicinity of a connecting part 21*d* shown in FIG. 2A is enlarged. In addition, FIG. 2B shows a perspective view of an enlarged local part of the connecting part 21*d* on which a slit 21*da* is formed. FIG. 2C shows a perspective view of an enlarged local part of the connecting part 21*d*, applicable to the terminal member 21, on which a hole 21*db* is formed. FIG. 3B shows a plan view of the connecting member 8, and FIG. 3A shows a sectional view taken along the cutting-plane line A-A' shown in FIG. 3B. FIG. 4 shows a perspective view of the connecting member 8. FIG. 5 schematically shows a plan view of the conductive damper 2*a*. FIG. 6 shows a perspective view in which a local part of the connecting member 8 corresponding to the mounting position of the terminal member 21 is enlarged. In addition, FIG. 6 is a diagram for explaining a method of mounting the terminal member 21 to the connecting member 8 and electrically connecting the voice coil 4 and the conductive damper 2*a*. FIG. 7 shows a perspective view of an enlarged local part of the vicinity of the connecting portion between the connecting part 21*d* and the connecting member 8. In addition, FIG. 7 is a diagram for explaining a method of connecting the connecting part 21*d* and the lead wire 4*a* of the voice coil 4. FIG. 8 shows a sectional view of an enlarged local part of the speaker device in a condition that the terminal member 21 is mounted to the connecting member 8.

First, the description will be given of a structure of the terminal member 21 for electrically connecting the conductive member of the conductive damper 2*a* and the lead wire 4*a* of the voice coil 4, with reference to FIGS. 2A to 2C. The terminal member 21 includes a ceiling wall 21*a*, the connecting part 21*d*, a raised wall 21*e*, a fixing part 21*b*, a bent part 21*f* and a connecting part 21*c*, and is mounted to the connecting member 8.

The ceiling wall 21*a* is formed into a planar shape, and has a hole 21*ab* substantially in its center. A projecting portion 8*f* of the connecting member 8 which will be described later is inserted into this hole 21*ab*. The connecting part 21*d* is formed by being folded to a lower side from one end side of the ceiling wall 21*a*. The slit 21*da* is formed in the connecting part 21*d* as shown in FIG. 2B. Instead, the hole 21*db* may be formed in the connection part 21*d* as shown in FIG. 2C. The end portion of the lead wire 4*a* of the voice coil 4 is wound around this slit 21*da*, and they are fixed by soldering. Thereby, the terminal member 21 and the lead wire 4*a* of the voice coil 4 are electrically connected.

The raised wall 21*e* extends downward from the other end side of the ceiling wall 21*a*. The fixing part 21*b* is formed into a substantially planar tongue shape, and extends downward from the lower end portion of the raised wall 21*e*. The bent part 21*f* extends substantially perpendicularly to an outside from the lower end part side of the raised wall 21*e*, namely, extends to the opposite side from the direction in which the ceiling wall 21*a* extends, and is bent to the down side at a predetermined position. The connecting part 21*c* extends substantially perpendicularly from the lower end portion side of the bent parts 21*f* to the outside, namely, extends in the opposite side of the direction in which the ceiling wall 21*a* extends. It is noted that the connecting part 21*c* and the ceiling wall 21*a* are substantially parallel.

Next, referring to FIGS. 3A and 3B and FIG. 4, the construction of the connecting member 8 will be explained in detail. The basic construction of the connecting member 8 is as described above. The connecting member 8 further includes an opening 8*k*, projecting portions 8*f*, slit portions 8*h*, slit portions 8*g*, and grooves 8*v*. A plurality of sets of projecting portions 8*f*, slit portions 8*h*, slit portions 8*g* and grooves 8*v* (hereinafter also called "a set of terminal mounting part 608") are formed in a circumferential direction of the connecting member 8 with constant spaces apart from each other. One terminal member 21 is mounted to one set of terminal mounting part 608.

The opening 8*k* is formed substantially at the center of the connecting member 8. The voice coil bobbin 3 is inserted into this opening 8*k*. The projecting portion 8*f* is formed into a substantially columnar shape, and projecting upward from an upper end surface of the bent portion 8*b*. The projecting portion 8*f* is inserted into the hole 21*ab* of the terminal member 21. Thereby, the movement of the upper end portion side of the terminal member 21 relative to the connecting member 8 can be prevented, and the upper end portion side of the terminal member 21 can be fixed to the connecting member 8. The terminal member 21 is hung on and mounted to the outer wall of the connecting member 8. The slit portion 8*h* is the slit formed on the upper end surface of the bent portion 8*b* at the side of the center axis O. The connecting part 21*d* of the terminal member 21 is disposed in this slit portion 8*h*. The slit portion 8*g* is the slit formed in an outer peripheral wall of the cylindrical portion 8*a*. The slit portion 8*g* is formed from the upper end portion of the outer peripheral wall of the cylindrical portion 8*a* to the vicinity of the lower end of the outer peripheral wall of the cylinder portion 8*a*. The raised wall 21*e* of the terminal member 21 is disposed in this slit portion 8*g*. The groove 8*v* is the groove formed at the lower position of the slit portion 8*g*. The fixing part 21*b* of the terminal member 21 is inserted into this groove 8*v*. Thereby, the movement of the terminal member 21 relative to the connecting member 8 to the side of the lower end portion can be prevented, and the lower end portion side of the terminal member 21 can be fixed to the connecting member 8.

Next, the structure of the conductive damper 2*a* will be described in detail with reference to FIG. 5. The basic structure of the conductive damper 2*a* is as described above. The conductive damper 2*a* further includes an opening 2*ab*, plural projecting parts 2*ac*, an elastic part 2*ad* and plural conductive members 2*ae*.

The opening 2*ab* is formed substantially at a center of the conductive damper 2*a*. The connecting member 8 is inserted into this opening 2*ab*. A plurality of projecting parts 2*ac* are extended outside from an outer peripheral edge portion of the conductive damper 2*a* and are each formed into a substantially rectangular shape. The respective projecting parts 2*ac* are formed at the positions where they are symmetrical to each other as shown in FIG. 5. The respective projecting parts 2*ac* and the outer peripheral edge portion of the conductive damper 2*a* are respectively mounted to the upper surface 9*a* of the above described support member 9. The elastic part 2*ad* is formed into a corrugated shape, and plays a role of movably supporting the connecting member 8. A plurality of conductive members 2*ae* are formed by a conductive member such as metal and play a role of electrically connecting lead wires 4*a* of the voice coil 4 and the terminal members 21. Each of the conductive members 2*ae* is woven into a flat net shape at a top surface side of the conductive damper 2*a* from an inner peripheral edge portion of the conductive damper 2*a* to an end portion side of the projecting part 2*ac*. The conductive members 2*ae* at the side of the inner peripheral edge portion of the conductive damper 2*a* are electrically connected to connecting parts 21*c* of the respective terminal members 21. Meanwhile, the conductive members 2*ae* at a side of the outer peripheral edge portion of the conductive damper 2*a* are electrically connected to one end sides of respective terminal members 22.

Next, the description will be given of a method of mounting the terminal member 21 to the connecting member 8 and electrically connecting the voice coil 4 and the conductive damper 2*a*, with reference to FIG. 6.

The terminal member 21 is mounted to a correspondent set of projecting portions 8*f*, slit portions 8*h* and 8*g*, and groove 8*v* in the direction of an arrow shown in FIG. 6. At this time, the projecting portion 8*f* of the connecting member 8 is inserted into the hole 21*ab* of the terminal member 21, and the fixing part 21*b* of the terminal member 21 is inserted into the groove 8*v* of the connecting member 8. Thereby, the terminal member 21 is fixed to the connecting member 8. The bottom surface of the connecting part 21*c* of the terminal member 21 is connected to the conductive member 2*ae* (a portion of an area E6) on the side of the inner peripheral edge portion of the conductive damper 2*a*. Afterward, the contact portion of the connecting part 21*c* and the conductive member 2*ae* is soldered, which is not shown. Thereby, the terminal member 21 and the conductive damper 2*a* are securely electrically connected.

As understood with reference to FIG. 7, by the known method, the connecting part 21*d* of the terminal member 21 and the lead wire 4*a* of the voice coil 4 are connected by winding the lead wire 4*a* of the voice coil 4 around the slit 21*da* of the connecting part 21*d* and soldering the portion of an area E8.

As described above, FIG. 8 shows a state that the terminal member 21 is mounted to the connecting member 8 and the voice coil 4 and the conductive damper 2*a* are electrically connected via the terminal member 21.

In such the state, as understood with reference to FIG. 2B and FIG. 8, the connecting part 21*d* is disposed in the slit portion 8*h*. The undersurface of the ceiling wall 21*a* is in contact with the upper end surface of the bent portion 8*b*. The raised wall 21*e* is in contact with the slit portion 8*g* of the connecting member 8. The fixing part 21*b* is inserted into the groove 8*v*. The lead wire 4*a* lead out from the voice coil 4 is lead along the outer peripheral wall of the voice coil bobbin 3 and the top surface of the bent portion 8*b*, and is electrically connected to the connecting part 21*d* of the terminal member 21 by a soldering 200. Meanwhile, the connecting part 21*c* of the terminal member 21 is electrically connected to the conductive member 2*ae* (see the broken line portion) at the side of the inner peripheral edge portion of the conductive damper 2*a* by the soldering 200. As described above, the voice coil 4 and the conductive damper 2*a* are electrically connected via the terminal member 21.

As described above, the wiring structure of the speaker device 100 according to this embodiment has an effect below, differently from the wiring structure of the normal speaker device.

In the wiring structure of the normal speaker device, the fine lead wire 4*a* is drawn up to the side of the conductive member 2*ae* of the conductive damper 2*a* along the upper surface of the bent portion 8*b* of the connecting member 8 and the outer peripheral wall of the cylindrical portion 8*a* of the connecting member 8. Like this, when the fine lead wire 4*a* is drawn in the long distance, the lead wire 4*a* is sometimes cut at the time of drawing.

On the contrary, in the wiring structure of the speaker device 100 according to this embodiment, the lead wire 4*a* drawn from the voice coil 4 is drawn up to the connecting part 21*d* of the terminal member 21 along the outer peripheral wall of the cylindrical portion 8*a*, and is connected to the connecting part 21*d*. Therefore, in comparison with the wiring structure of the normal speaker device, the lead wire 4*a* is not drawn in so long distance. Therefore, at the time of drawing the lead wire 4*a*, it can be prevented that the lead wire 4*a* is cut.

In the wiring structure of the normal speaker device, for the purpose of preventing ignition at the time of inputting the direct current to the lead wire 4*a*, and for the purpose of preventing occurrence of an abnormal sound due to the collision of the lead wire 4*a* and the connecting member 8 at the time of driving the speaker device, the adhesive is sometimes applied to the portion of the lead wire 4*a* in contact with the connecting member 8. However, if the adhesive is applied to the contact portion of the outer peripheral wall of the cylindrical portion 8*a* of the connecting member 8 and the lead wire 4*a*, the adhesive drops on the side of the lower end portion of the cylindrical portion 8*a*, and the lead wire 4*a* of the contact portion is exposed. Therefore, the above-mentioned purposes cannot be sometimes achieved.

On the contrary, in the wiring structure of the speaker device 100 of this embodiment, as described above, the lead wire 4*a* is not drawn up to the side of the outer peripheral wall of the cylindrical portion 8*a*. Thus, such the problem does not occur.

Moreover, in the wiring structure of the normal speaker device, the fine lead wire 4*a* is drawn up to the side of the conductive damper 2*a* in a manner to avoid its cutting, and the lead wire 4*a* and the conductive member of the conductive damper are soldered. Thus, the operation at the time of the soldering is inefficient.

On the contrary, in the wiring structure of the speaker device 100 of the present embodiment, only by mounting the terminal member 21 to the connecting member 8, the connecting part 21*c* of the terminal member 21 and the conductive member 2*ae* of the conductive damper 2*a* are electrically connected. Therefore, the work of the soldering to such the connecting portion can be rapidly and easily performed.

[Another Application]

Figure 10:
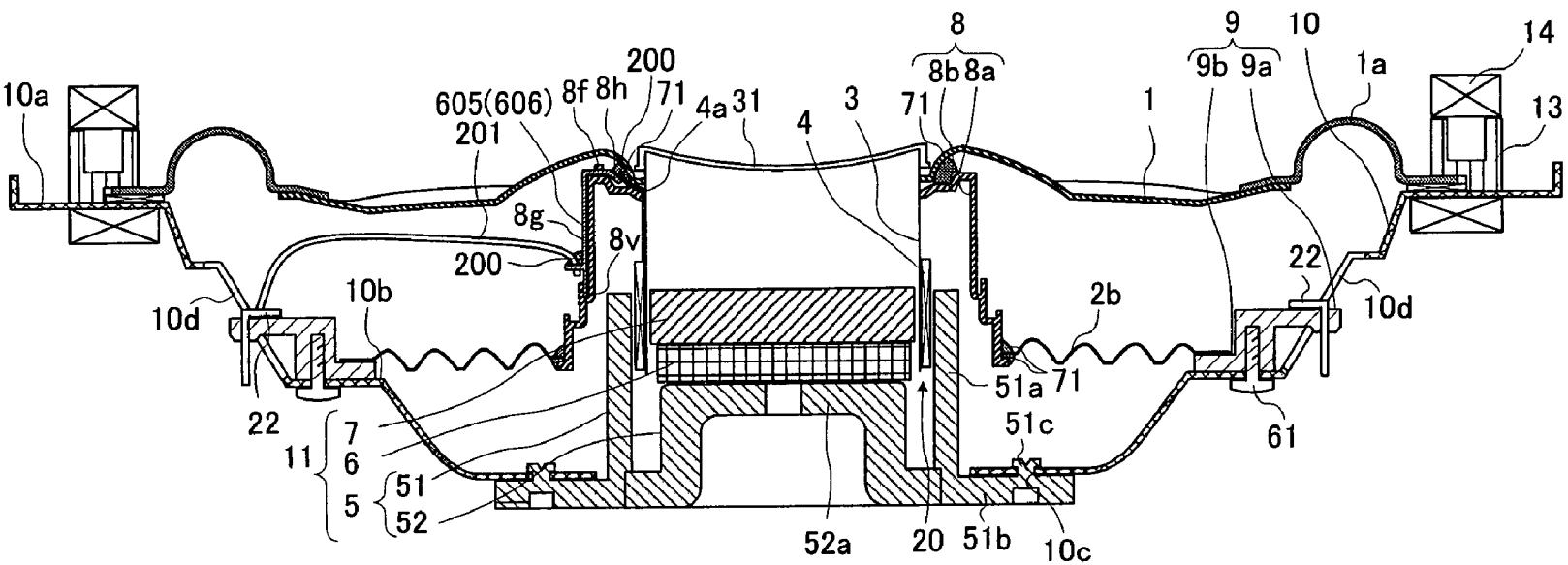
FIG. 10 shows another example in the case that the wiring structure of the present invention is applied to the speaker device having the tinsel cord.
Figure 11:
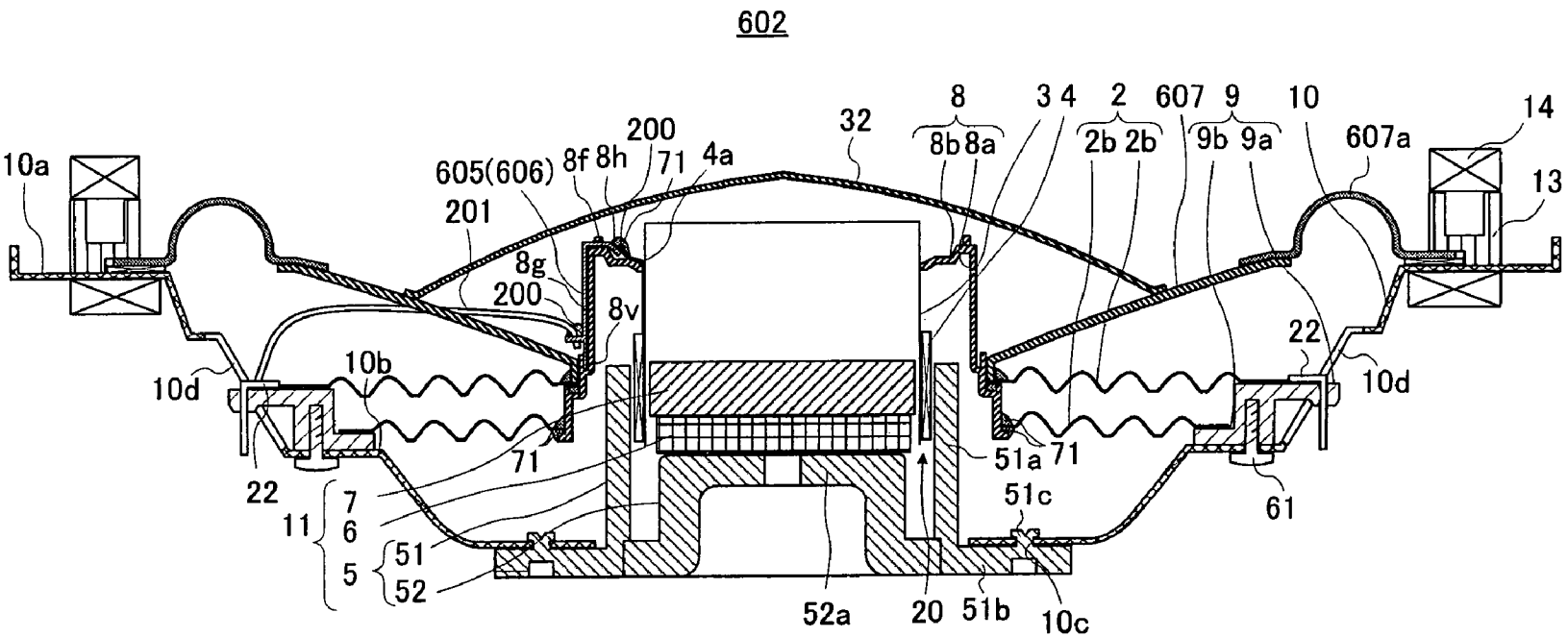
FIG. 11 shows still another example in the case that the wiring structure of the present invention is applied to the speaker device having the tinsel cord.

In the above-mentioned embodiment, the wiring structure of the present invention is applied to the speaker device 100 in such the type that the electric signal from the amplifier is inputted to the voice coil 4 through the conductive damper 2*a* and the like. However, the application is not limited to it. Namely, as shown in FIG. 9 to FIG. 11, the wiring structure of the present invention can be applied to the speaker device in such the type that the electric signal from the amplifier is inputted to the voice coil 4 through a tinsel cord 201, too.

Figure 9:
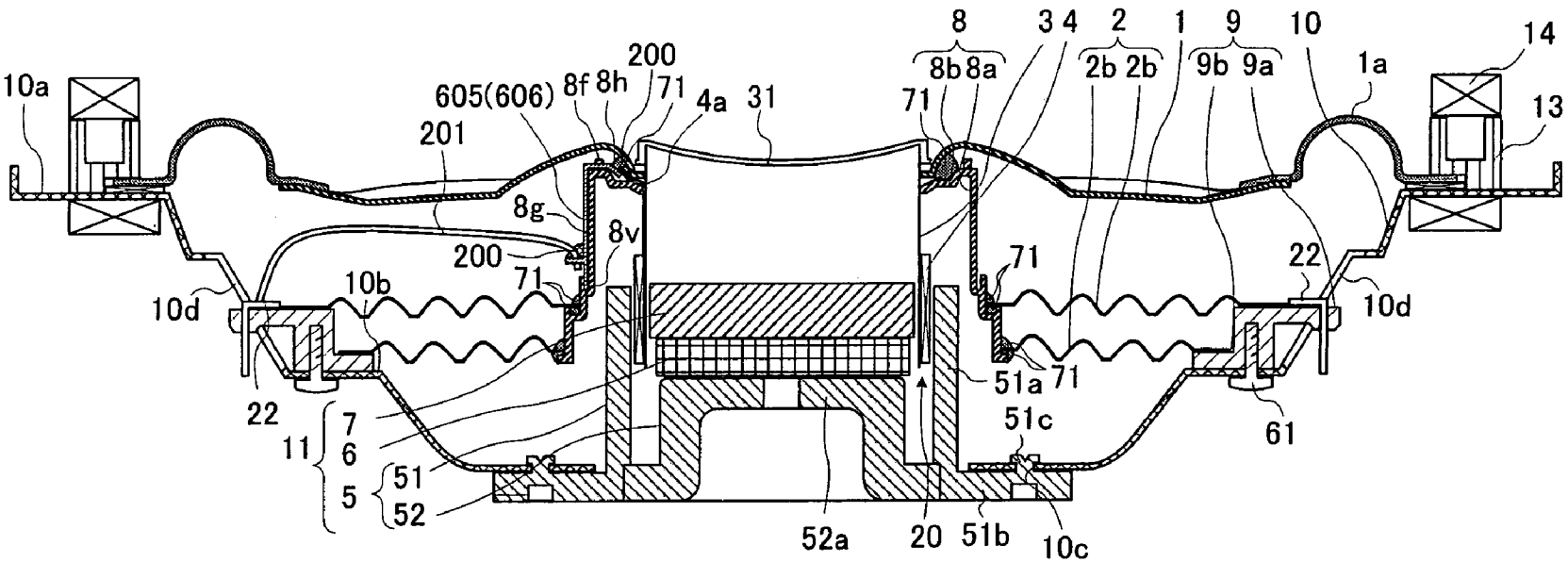
FIG. 9 shows an example in a case that a wiring structure of the present invention is applied to a speaker device having a tinsel cord.
Figure 12B:
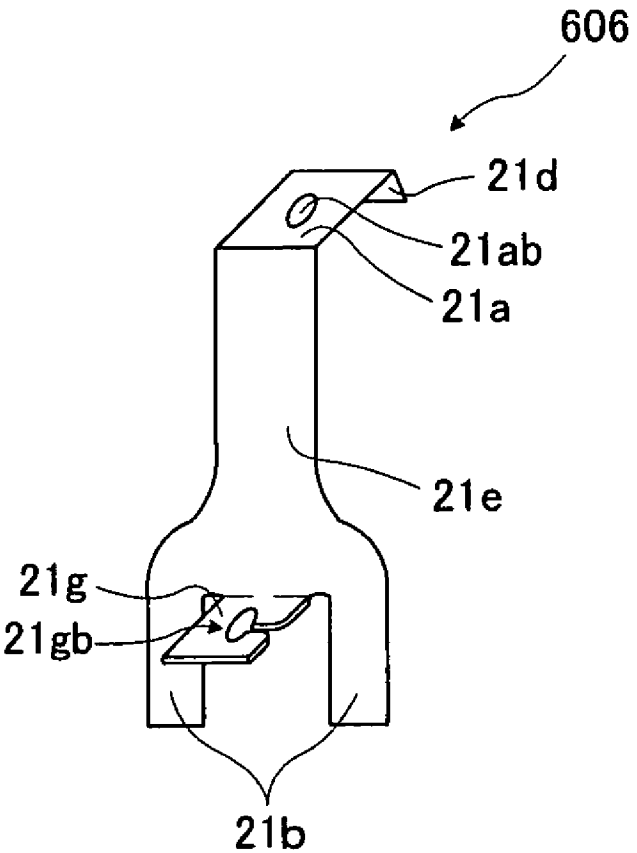
FIGS. 12A and 12B show various embodiments of the terminal member applicable to the speaker device having the tinsel cord.
Figure 12A:
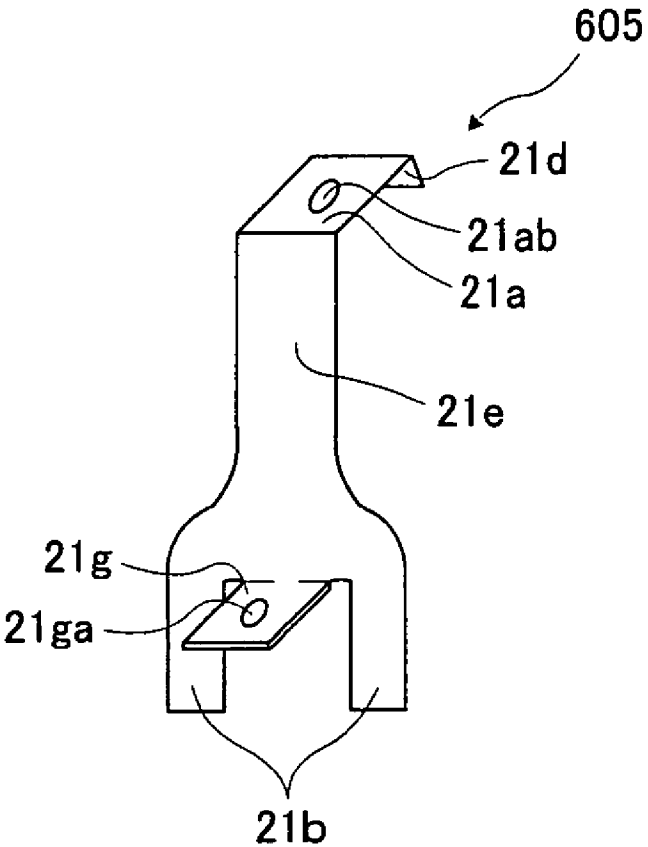

FIG. 9 is a sectional view of a speaker device 600 having the tinsel cord 201 and the plural ordinary dampers 2, and shows an example in a case that the wiring structure of the present invention is applied to the speaker device 600. FIG. 10 is a sectional view of a speaker device 601 having the tinsel cord 201 and one ordinary damper 2, and shows an example in a case that the wiring structure of the present invention is applied to the speaker device 601. FIG. 11 is a sectional view of a speaker device 602 having the tinsel cord 201 and a corn-shape diaphragm 607, and shows an example in a case that the wiring structure of the present invention is applied to the speaker device 602. FIGS. 12A and 12B are perspective views schematically showing structures of terminal members 605 and 606 applicable to the speaker devices shown in FIG. 9 to FIG. 11, respectively.

Before the structures of the speaker devices 600 to 602 are explained, the description will be given of the structures of the terminal members 605 and 606.

First, the structure of the terminal member 605 will be explained.

In comparison with the above-mentioned terminal member 21, the terminal member 605 does not have the bent part 21*f* and the connecting part 21*c* which are the components of the terminal member 21. Instead, the terminal member 605 has the connecting part 21*g* and the plural fixing parts 21*b* in tongue shapes.

As shown in FIG. 12A, the connecting part 21*g* extends outward from the lower end portion of the raised wall 21*e*, i.e., on the side opposite to the direction in which the ceiling wall 21*a* extends. A hole 21*ga* is formed at a substantial center of the connecting part 21*g*. One end side of the tinsel cord 201 is wound around the hole 21*ga*. The plural fixing parts 21*b* are inserted into the groove 8*v* of the connecting member 8.

Next, the description will be given of the structure of the terminal member 606.

The structure of the terminal member 606 is substantially similar to the structure of the terminal member 605. However, unlike the terminal member 605, the terminal member 606 has a slit 21*gb* on the connecting part 21*g*, instead of the hole 21*ga*. The one end side of the tinsel cord 201 is wound around the slit 21*gb*.

If the above-mentioned terminal members 605 and 606 are applied to the speaker devices 600, 601 and 602, only by winding the one end side of the tinsel cord 201 around the hole 21*ga* and the slit 21*gb*, the tinsel cord 201 and the terminal member 21 can be easily electrically connected.

Next, the description will be briefly given of the speaker devices 600 to 602 to which the wiring structure of the present invention is applied, with reference to FIG. 9 to FIG. 11.

Unlike the speaker device 100, the speaker device 600 shown in FIG. 9 has no conductive damper 2*a*. Instead, the speaker device 600 has the plural ordinary dampers 2*b* and the tinsel cord 201. The one end side of the tinsel cord 201 is connected to the connecting part 21*d* of the terminal member 605 or 606. The contact portion of the connecting part 605 or 606 and the tinsel cord 201 are soldered by the soldering 200. Meanwhile, the other end side of the tinsel cord 201 is connected to the one end side of the terminal member 22. Thereby, in the speaker device 600, the relay wiring on the side of the amplifier, the terminal member 22, the tinsel cord 201, the terminal member 605 or 606 and the lead wire 4*a* of the voice coil 4 are electrically connected.

The structure of the speaker device 601 shown in FIG. 10 is substantially similar to the structure of the speaker device 600. However, the speaker device 601 has the only ordinary damper 2, which is different from the speaker device 600. Namely, the wiring structure of the present invention is applicable to the speaker device 601 having one damper 2, too. Thereby, in the speaker device 601, the relay wiring on the side of the amplifier, the terminal member 22, the tinsel cord 201, the terminal member 605 or 606 and the lead wire 4*a* of the voice coil 4 are electrically connected.

The structure of the speaker device 602 shown in FIG. 11 is substantially similar to the structures of the above-mentioned speaker devices 600 and 601. However, in the speaker device 602, the diaphragm 607 is formed into the corn shape, which is mainly different from the above-mentioned speaker devices 600 and 601. The speaker device 602 has an antidust cap 32 to cover the voice coil bobbin 3, the connecting member 8 and the like. Namely, the wiring structure of the present invention is applicable to the speaker device 602 having the corn-shape diaphragm 607, too. Thereby, in the speaker device 602, the relay wiring on the side of the amplifier, the terminal member 22, the tinsel cord 201, the terminal member 605 or 606 and the lead wire 4*a* of the voice coil 4 are electrically connected.

As described above, in the speaker devices 600 to 602 having the tinsel cord 201, by mounting the terminal member 605 or 606 to the connecting member 8, the tinsel cord 201 can be rapidly and easily connected to the terminal member 605 or 606.

What is claimed is:

1. A speaker device comprising:

a frame;

a conductive damper which has an outer peripheral edge portion supported by the frame;

a connecting member which is mounted to the conductive damper and which movably supports a voice coil bobbin;

a voice coil which is wound around the voice coil bobbin; and a terminal member which is mounted to the connecting member and which is electrically connected to the conductive damper and the voice coil, wherein a projecting portion projecting upward is formed on an upper end surface of the connecting member, and a groove is formed at a lower end portion of the connecting member, and wherein a hole into which the projecting portion is inserted is formed on an upper end surface of the terminal member, and a fixing part which is inserted into the groove is formed at a lower end portion of the terminal member.

2. The speaker device according to claim 1, wherein the terminal member has a slit or a hole to which a lead wire of the voice coil is connected.

3. The speaker device according to claim 1, wherein a connecting part for electrically connecting to a conductive member of the conductive damper is formed at the lower end portion of the terminal member.

4. A speaker device comprising:

a frame;

a damper which has an outer peripheral edge portion supported by the frame;

a connecting member which is mounted to the damper and which movably supports a voice coil bobbin;

a voice coil which is wound around the voice coil bobbin; and a terminal member which is mounted to the connecting member and which is electrically connected to an end portion of the voice coil, wherein a projecting portion projecting upward is formed on an upper end surface of the connecting member, and a groove is formed at a lower end portion of the connecting member, and wherein a hole into which the projecting portion is inserted is formed on an upper end surface of the terminal member, and a fixing part which is inserted into the groove is formed at a lower end portion of the terminal member.

* * * * *